US005541378A

United States Patent [19]

Niklaus

[11] Patent Number: 5,541,378

[45] Date of Patent: Jul. 30, 1996

[54] DRIVE DEVICE FOR A POWER SWITCH

[75] Inventor: Rolf Niklaus, Unterentfelden, Switzerland

[73] Assignee: GEC Alsthom T&D AG, Oberentfelden, Switzerland

[21] Appl. No.: 350,878

[22] Filed: Dec. 7, 1994

[30] Foreign Application Priority Data

Dec. 13, 1993 [EP] European Pat. Off. ..... 93120052

[51] Int. Cl.[6] ..... H01H 3/40

[52] U.S. Cl. ..... 200/400; 200/501; 74/567

[58] Field of Search ..... 200/48 R, 49, 200/400, 501; 74/567, 569

[56] References Cited

U.S. PATENT DOCUMENTS

| | | | |
|---|---|---|---|
| 3,072,763 | 1/1963 | Goodwin, Jr. | 200/92 |
| 3,203,505 | 8/1965 | Hannauer | 185/40 |
| 3,890,853 | 6/1975 | Feltz | 74/435 |
| 4,649,244 | 3/1987 | Baginski et al. | 200/153 |

FOREIGN PATENT DOCUMENTS

| | | |
|---|---|---|
| 208451 | 4/1960 | Austria . |
| 0294561 | 4/1988 | European Pat. Off. . |
| 294561 | 4/1988 | European Pat. Off. . |
| 2244613 | 9/1972 | Germany . |
| 561956 | 4/1974 | Switzerland . |
| 1273014 | 9/1969 | United Kingdom . |

*Primary Examiner*—Renee S. Luebke
*Attorney, Agent, or Firm*—Keck, Mahin & Cate

[57] ABSTRACT

A drive device includes a cam disk (18), which, for switching on the power switch, can be driven by means of an energy store, impulsively, in a direction of rotation (D). A first section (48) of the curve path (20) of the cam disk (18), which, as the azimuth increases counter to the direction of rotation (D), exhibits an increasing radius, is adjoined by an intermediate section (50) of steadily decreasing radius. After this intermediate section (50) there follows a second section (52), running roughly in the radial direction. As a result of the interaction of the first section (48) with the roller (22'), the triangular lever (76), together with the control shaft (26), moves counter to the direction of rotation (D) out of the switch-off setting into the switch-on setting and by a measure of one overtravel (U) beyond this. When the intermediate section (50) is moved past the roller (22'), the triangular lever (76) moves under the force of the now tensioned disconnecting spring slowly back in the direction of rotation (D), until it is positioned with its pawl boss (78) in contact with the connecting pawl (72). As a result of this slow return motion, impact forces acting upon the pawl (34) are greatly reduced.

8 Claims, 2 Drawing Sheets

DRIVE DEVICE FOR A POWER SWITCH

FIELD OF THE INVENTION

The present invention relates to a drive device for a power switch, in particular for medium and high voltage.

BACKGROUND OF THE INVENTION

A drive device of this type is disclosed in DE-A-25 17 134. On a shaft mounted rotatably about its axis, which shaft is acted upon eccentrically by an energy store configured as a tension spring, there is seated in rotationally secure arrangement a cam disk, the curve path of which exhibits a first section having a radius which steadily increases as the azimuth increases counter to the direction of rotation of the shaft. The rear end of the first section, in the direction of rotation, is directly adjoined by a second section, running roughly in the radial direction, of abruptly decreasing radius, which second section is adjoined, counter to the direction of rotation, by a third section, which runs up to the start of the first section and exhibits a radius roughly corresponding to the radius at the start of the first section.

A control shaft connected to the movable contact of the power switch is disposed parallel to the shaft and, seated on the shaft, in rotationally secure arrangement, there is a disk from which there eccentrically protrudes, relative to the axis of the control shaft, a pin-like follow-up member. In addition, the shaft is connected to a disconnecting spring. On its periphery, the disk exhibits a latch recess which is designed to interact with a disconnecting pawl of a ratchet device.

For the tensioning of the connecting spring, the shaft is rotated out, in the direction of rotation, to above the unstable dead center and is held there supported by a connecting pawl. For the switching-on of the switch, the connecting pawl is tripped, whereby the shaft, due to the force of the connecting spring, starts to rotate in the direction of rotation. The cam disk hereupon runs with its first section onto the follow-up member and, upon further rotation, pivots the control shaft out of its switch-off setting into the switch-on setting and by a measure of one overtravel beyond this. This overtravel is generally necessary to ensure the latching of the ratchet device. As soon as the first section of the curve path runs off from the follow-up member, the disconnecting spring accelerates the control shaft until it is in contact with the disconnecting pawl. The ratchet device has thus not only to support the force of the disconnecting spring, but also to absorb the additional impact stress resulting from the impacting upon the disconnecting pawl. For the activation and simultaneous tensioning of the disconnecting spring, the shaft rotates by about 180°, the surplus energy being recuperated into the connecting spring by rotation beyond the stable dead center position.

A further drive device of the generic type is disclosed in CH-A-498 480. A cam disk, which can be rotated by means of connecting springs, for switching on the switch, respectively by 360° in the direction of rotation exhibits a curve path having a first and a second section. The radius of the first section increases steadily in a spiral, as the azimuth increases counter to the direction of rotation, and sweeps an angle of almost 360°. Extending between the end of the first section of largest radius and its start there is the abruptly down-sloping second section, which extends in the radial direction. Interacting with the cam disk is a follow-up member, configured as a roller, which is mounted at the one end of a twin-armed lever, the other end of which is designed to interact with a ratchet device and which is connected to the movable contact of the power switch and a disconnecting spring. As a result of the impulsive rotation of the cam disk by 360°, the lever is moved out of its switch-off setting from the first section, as the switch is simultaneously switched on and the disconnecting spring tensioned, into the switch-on setting and beyond this. If the first section runs off from the follow-up member, the disconnecting spring accelerates the lever in the opposite direction until the latter is in contact with the ratchet device. Here too, the ratchet device has to absorb, in addition to the force of the disconnecting spring, the dynamic force resulting from the impacting of the lever, also.

In both the known drive devices, the ratchet device must therefore be dimensioned in correspondingly large size. This requires a considerable amount of space and leads to large masses, which have to be moved for unlatching purposes. The movement of these large masses calls, in turn, for high drive powers for the ratchet device or it results in a slow unlatching procedure.

A drive device exhibiting a cam disk, which drive device possesses, in relation to the two aforementioned drive devices, a different structure and a different working method, is disclosed in EP-A-0 150 756.

A roller-like follow-up member, which interacts with the curve path of the cam disk, is disposed on a lever which is actively connected to the connecting spring. The curve path of the cam disk, which cam disk can be driven by a motor or by hand in the direction of rotation, exhibits a first section of a radius which steadily increases as the azimuth increases counter to the direction of rotation. Counter to the direction of rotation, this first section is adjoined by a section of a radius which slowly becomes steadily smaller as the azimuth increases, which section is adjoined, for its part, by a second section running essentially in the radial direction, which is followed at the inner end by the first section. When the connecting spring is relaxed, the follow-up member bears against the start of the first section. By the slow rotation of the cam disk in the direction of rotation by somewhat less than 360° up to the end of the first section, the connecting spring is tensioned. Upon the interaction of the follow-up member with the subsequent section of slowly decreasing radius, the connecting spring has the effect of driving the cam disk in the direction of rotation. The cam disk, which is now decoupled from the motor, is prevented however, by means of a ratchet device, from further rotating. For the switching-on of the power switch connected to the drive device, the ratchet device is excited in order to release the cam disk. The latter, under the force of the connecting spring acting via the lever, starts to rotate and the follow-up member makes its way onto the abruptly down-sloping second section, so that there is now no longer any counter-force exerted by the cam disk against the action of the connecting spring. Under the force of the connecting spring, the follow-up member is now suddenly accelerated as the switch is simultaneously switched on and a disconnecting spring is tensioned. In this particular drive device, the cam disk is used to tension the connecting spring and additionally acts as a ratchet transmission. In this known drive device, furthermore, it is necessary after the switching-on, by means of a special device, to decouple the switch and disconnecting spring from the connecting spring.

SUMMARY OF THE INVENTION

An object of the present invention is to provide a drive device of the generic type in which there is little load upon the ratchet device, so that the latter can be built lighter and such that it requires less space.

This object is achieved by a drive device described below.

Since the follow-up member, until being supported against the ratchet device, bears against an intermediate section of the curve path, the run-up onto the ratchet device occurs at low speed, so that the dynamic impact forces are considerably reduced or even averted. The ratchet device can thus be dimensioned according to the static force action of the disconnecting spring and the reduced dynamic impact forces, thereby enabling the ratchet device and the entire drive device to be built in a light, space-saving construction. Since the moved masses of the ratchet device can thereby be kept small, a rapid unlatching is effected and/or there is less work to be expended upon the unlatching.

A particularly preferred embodiment of the drive device according to the invention enables large tolerances to be absorbed.

A further preferred embodiment of the drive device according to the invention enables the first and second sections of the curve path to be configured in a smaller azimuth range than if a further section of constant radius had been present between the first section and the intermediate section.

Further particularly preferred embodiments of the device according to the invention are defined below.

BRIEF DESCRIPTION OF THE DRAWINGS

The invention is now explained in greater detail with reference to the drawings which, in diagrammatic form, illustrate the following.

DETAILED DESCRIPTION OF THE PREFERRED EMBODIMENTS

Figure 1:
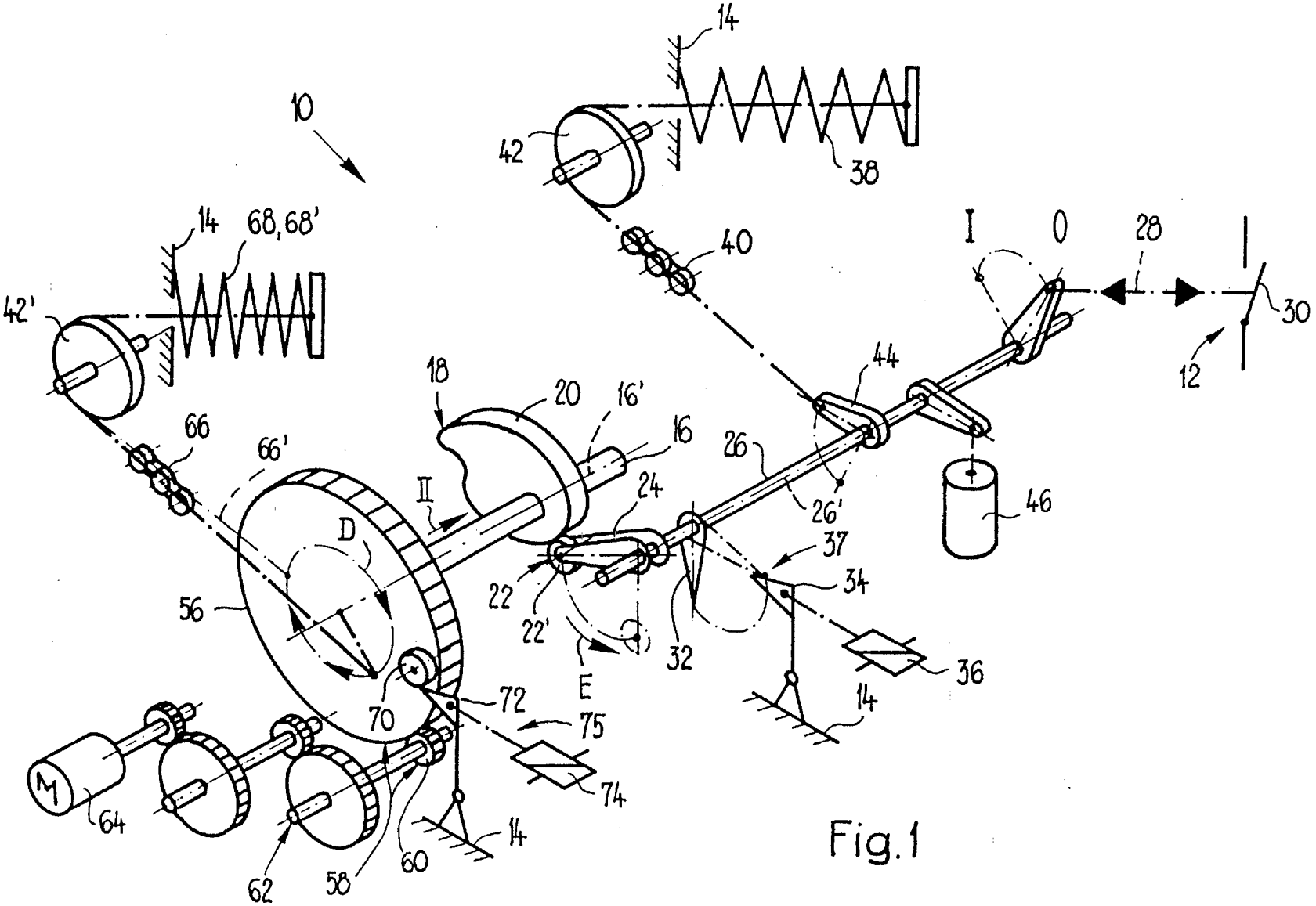
FIG. 1 shows a perspective and simplified representation of a drive device according to the invention.

The drive device 10 shown in FIG. 1 for driving a power switch 12, indicated only diagrammatically, for medium or high voltage, has a shaft 16 which is mounted freely rotatably, in a known manner, on a stand 14 and on which there is seated, in rotationally secure arrangement, a cam disk 18. The contacting surface of the cam disk 18 forms a curve path 20, which interacts with a roller 22' acting as a follow-up member 22. The roller 22' is mounted freely rotatably at the free end of a lever 24, which is seated in rotationally secure arrangement on a control shaft 26 parallel to the shaft 16. The control shaft 26 is likewise mounted freely rotatably on the stand 14 and is connected, via a linkage 28, to the moved contact piece 30 of the power switch 12. On the control shaft 26 there is seated, also in rotationally secure arrangement, a ratchet lever 32, which is designed, in the switch-on setting I represented by dash-dotted lines, to interact with a pawl 34 supported against the stand 14. The pawl 34 can be pivoted, by means of a disconnecting electromagnet 36 for releasing the ratchet lever 32 and hence the control shaft 26, out of a support setting into a release setting. The ratchet lever 32, the pawl 34 and the disconnecting electromagnet 36 form a ratchet device 37.

A disconnecting spring 38 configured as a helical compression spring is supported at the one end against the stand 14 and is connected at the other end to a traction mechanism 40 configured as a chain, which traction mechanism is diverted about a deflection wheel 42 mounted freely rotatably on the stand 14 and is attached in an articulated manner at the other end to a drive lever 44 seated in rotationally secure arrangement on the control shaft 26. If the control shaft 26 is rotated, in the switch-on setting I, the drive lever 44 runs roughly at right-angles to the direction of attack of the traction mechanism 40; in the switch-off setting 0 of the control shaft 26, the direction of attack of the traction mechanism 40 is almost in straight-line position relative to the drive lever 44.

For the sake of completeness, it is worth mentioning that the control shaft 26 is connected to a damping element 46, so as to enable the rotation motion of the control shaft 26, towards the end of a switch-off cycle, to be dampened.

Figure 2:
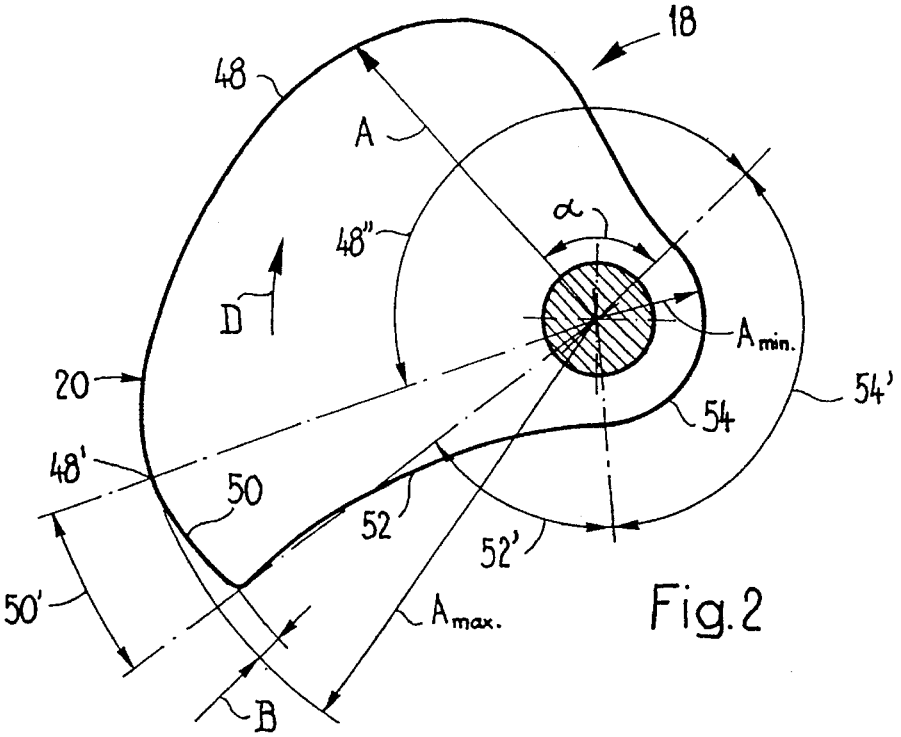
FIG. 2 shows a view of the cam disk of the drive device of FIG. 1, taken in the direction of the arrow II of FIG. 1.

As can be seen in particular from FIG. 2, the curve path 20 of the cam disk 18 exhibits a first section 48, which, as the azimuth increases counter to the direction of rotation indicated by an arrow D, exhibits a steadily increasing radius A. In the present example, the first section 48 extends at an angle 48" of about 155°. The end 48' of the first section 48 of maximum radius A, viewed counter to the direction of rotation D, is directly adjoined by an intermediate section 50, the radius A of which decreases slowly and steadily as the azimuth increases. The intermediate section 50 extends over an angle 50' of preferably 10°–20°, in the present case of about 17°, and within it the radius A decreases by an amount B roughly equivalent to 0.2 to 5%, preferably 0.5 to 1.5%, of the difference between the minimum radius $A_{min}$ at the start of the first section 48 and the largest radius $A_{max}$ at the end 48' of the first section 48.

Counter to the direction of rotation D, the intermediate section 50 is adjoined by a second section 52, which is concavely curved with a radius which is larger than the radius of the motional path of the follow-up member 22 and whose end region which abuts the intermediate section 50 runs roughly in the radial direction. The second section 52 extends, in the shown example, over an angle 52' of about 57°. This second section 52 enables the control shaft 26 to be rotated out of the switch-on setting I into the switch-off setting 0, without the follow-up member 22 hereupon making contact with the cam disk 18 (compare also FIG. 6).

Counter to the direction of rotation D, the second section 52 is adjoined by a third section 54 of a radius A, which corresponds to the minimum radius $A_{min}$ at the start of the first section and which extends over an angular sector 54' up to the start of the first section 48.

On the shaft 16 there is further seated, in rotationally secure arrangement, a large wheel 56 of a toothed wheel pair 58, the small wheel 60 of which is connected via a gearing 62 to a lift motor 64. A preferred embodiment of this wheel pair 58 is disclosed in European Patent Application No. 93 117 797.6.

Attached to the large wheel 56, eccentrically to the axis 16' of the shaft 16, is a chain forming a traction element 66, which chain is guided about a further deflection wheel 42' mounted rotatably on the stand 14 and, at the other end, is actively connected to a connecting spring 68. This is configured as a helical compression spring and is likewise supported against the stand 14; it forms an energy store 68'.

Figure 3:
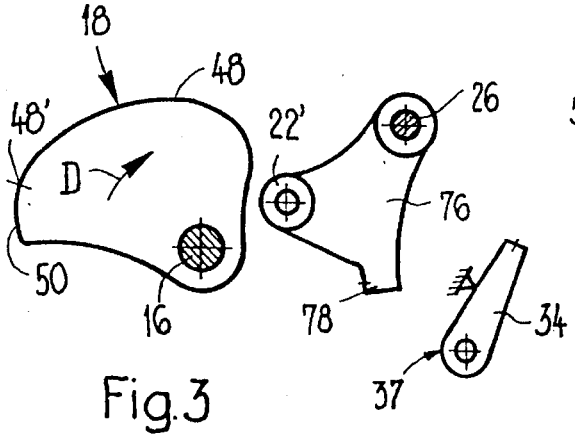
FIG. 3 shows, in greatly simplified representation, the cam disk, the lever carrying the follow-up member which interacts with the cam disk and the ratchet device of the drive device according to the invention in switch-off setting.
Figure 4:
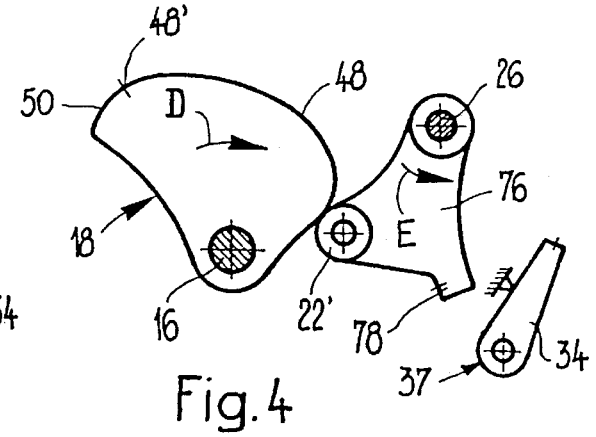
FIG. 4 shows the components of the drive device which are shown in FIG. 3, at the start of a switch-on cycle.
Figure 5:
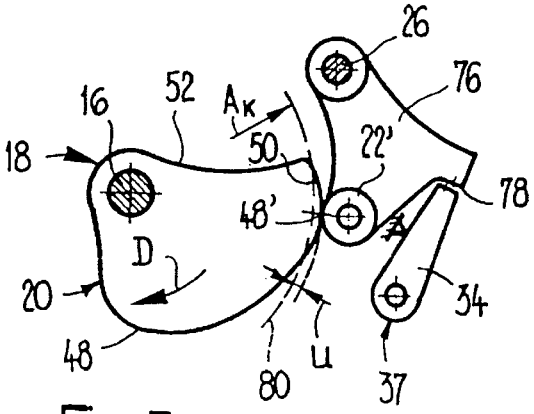
FIG. 5 shows the components of the drive device according to the invention which are shown in FIG. 3, during the switch-on cycle upon maximum deflection of the lever.
Figure 6:
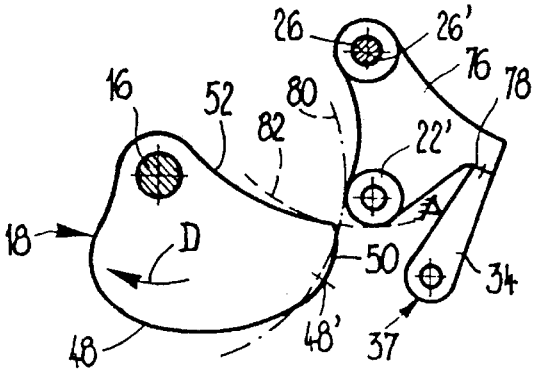
FIG. 6 shows those components of the drive device which are shown in FIG. 3 at the end of the switch-on cycle.

To the large wheel 56, furthermore, there is fastened a latch pin 70, which interacts with a connecting pawl 72 mounted on the stand 14. The said connecting pawl is connected to a connecting electromagnet 74, by means of which the connecting pawl 72 can be withdrawn from a support setting, in which it engages in the motional path of the latch pin 70, into a release setting. The latch pin 70, the connecting pawl 72 and the connecting electromagnet 74 form a connecting ratchet device 75. For the tensioning of the connecting spring 68, the large wheel 56 can be rotated by means of the lift motor 64 in the direction of rotation D, starting from the stable dead center position 66' indicated in dash-dot representation, by 180° into the unstable dead center position and beyond, whereafter the latch pin 70, upon further rotation about an angle of a few degrees and after reaching the unstable dead center point position, runs up onto the connecting pawl 72 and, under the effect of the tensioned connecting spring 68, is held in contact against this. The lift motor 64 is switched off once the unstable dead center position is crossed. When the large wheel 56 is supported, the cam disk 18 assumes a position in which the follow-up member 22, brought into the switch-off setting 0, comes to be situated by the start of the first section 48, as is shown in FIG. 3. This figure and the further FIGS. 4–6 show the cam disk 18, a triangular lever 76, which forms the lever 24 and the ratchet lever 32 and is seated on the control shaft 26 and on which the roller 22' is mounted freely rotatably, and the pawl 34 of the ratchet device 37. The pawl boss interacting with the pawl 34 and corresponding to the ratchet lever 32 (FIG. 1) is denoted by 78.

In FIG. 5, the dash-dotted segment 80 of a circle about the axis 16' of the shaft 16 indicates that radius $A_k$ which corresponds to the position of the follow-up member 22 and the roller 22' respectively when the triangular lever 76 bears with its pawl boss 78 against the pawl 34; this is the switch-on setting. The segment 80 intersects both the first section 48 and the intermediate section 50 of the curve path 20. The double arrow U denotes an overtravel, which is given by the difference between the largest radius $A_{max}$ of the first section 48 of the curve path 20 and the radius $A_k$.

Lastly, in FIG. 6, a further segment 82 of a circle about the axis 26' of the control shaft 26, which segment is indicated in dash-dot representation, shows the motional path of the roller 22' whenever switching occurs.

The working method of the drive device 10 is explained below with reference to FIGS. 1 to 6. In FIGS. 1 and 3, the drive device 10 is shown with the connecting spring 68 tensioned and the control shaft 26 located in the switch-off setting 0. In order to switch on the power switch 12 and simultaneously tension the disconnecting spring 38, the connecting electromagnet 74 is briefly excited, whereby the connecting pawl 72 releases the latch pin 70 and the shaft 16 together with the cam disk 18, under the force of the connecting spring 68, starts to rotate in the direction D. The cam disk 18 hereupon runs onto the roller 22' and, as it interacts with the first section 48 of the curve path 20, rotates the triangular lever 76 and hence the control shaft 26 in the switch-on direction E, which is opposed to the direction of rotation D (FIG. 4). At the same time, the power switch 12 is closed and the disconnecting spring 38 is tensioned. The pawl boss 78 forces the pawl 34 clockwise back out of its support setting, which pawl, by back-rotation into the support setting, engages behind the pawl boss 78 as soon as the cam disk 18 has reached that position in which the junction point of the first section 48 of the curve path 20 with the segment 80 runs by the roller 22'. As FIG. 5 shows, the triangular lever 76 is moved by a measure of one overtravel U beyond the switch-on setting, in order to ensure, under all conditions, the ratcheting of the ratchet device 37. This setting is reached when the end 48' of the first section 48 of radius $A_{max}$ interacts with the roller 22'. In this setting of the shaft 16, the articulated attachment of the traction element 66 is preferably located, at least approximately, in the stable dead center position. Upon further rotation of the cam disk 80 in the arrow direction D, as a result of the kinetic energy which is still present, the intermediate section 50 enters into interaction with the roller 22', whereby the control shaft 26 subjected to the force of the tensioned disconnecting spring 38 moves back, in accordance with the intermediate section 50, counter to the switch-on direction E, until the pawl boss 78 is in contact with the ratchet lever 76. This is achieved in that rotational position of the cam disk 18 in which the point of intersection of the intermediate section 50 with the segment 80 is in contact against the roller 22'. As FIG. 6 shows that the cam disk 18 continues rotating out of the swivel region of the roller 22', so that now at any time, by activation of the disconnecting electromagnet 74, the power switch 12 can be switched off again by the force of the disconnecting spring 38. The kinetic energy of the masses moving together with the shaft 16, which kinetic energy is still present when the dead center position 66' is reached, is recuperated by the partial tensioning of the connecting spring 68 as rotation proceeds beyond the stable dead center point 66'. The energy delivered by the disconnecting spring 38, via the intermediate section 50, to the cam disk 18 is hereupon likewise recuperated into the connecting spring 68. A back-rotation counter to the direction of rotation D is prevented by means of a return lock in the gearing 62. For the full tensioning of the connecting spring 68, the lift motor 64 is now switched on until the unstable dead center position is crossed and the latch pin 70 bears again against the connecting pawl 72. Upon tensioning of the connecting spring 68, the third section 54 moves past the motional path 82 of the follow-up member 20', thereby enabling the power switch 12 to be switched off at any time. The drive device 10 is now ready to switch the power switch 12 immediately back on.

The reduction of the radius A of the intermediate section 50 of the curve path 20 is tailored in such a way, with respect to the corresponding rotation speed of the shaft 16, that the pawl boss 78 runs at low speed onto the disconnecting pawl 34. In any event, the triangular lever 76, until coming to bear against the disconnecting pawl 34, is supported by the cam disk 18.

The cam disk 18 shown in FIG. 2, together with the stated angles and radii, should be regarded only as an example and both the angles and the radii may vary considerably. For instance, the inventive shape of the cam disk 18 can also be used in a drive device in which the cam disk is rotated by 360° to switch on the power switch, as is the case in the drive device disclosed in CH-A-498 480. The first section of the curve path of steadily increasing radius and the intermediate section of slowly and steadily decreasing radius herein together extend over an angle of almost 360°, thereby ensuring, by the second section running essentially in the radial direction, that the follow-up member is able to move past the cam disk 18 upon the power switch being switched off.

In the example shown in the Figures, the intermediate section extends preferably over an angle 50' of between 10° and 20°. It is also however conceivable that this angle, in particular in the case of a switching device in which the cam disk rotates by 360° to switch on the power switch, is greater than 20°. In any event, the reduction B in the radius in the intermediate section 50 is at least as large, preferably larger, than the overtravel U.

What is claimed is:

1. A drive device for a power switch, for medium or high voltage, having a cam disk which, for switching on the power switch, is driven by means of an energy store about an axis in a direction of rotation and which comprises a curved path which includes a first section of a radius which increases as the azimuth increases counter to the direction of rotation, and a second section which follows behind the first section in the direction of rotation and runs roughly in the radial direction, having a follow-up member which is forced by a disconnecting spring in the direction of the cam disk and which by rotation of the cam disk in the direction of rotation by means of the first section of the curved path is moved from a switch-off setting, as the disconnecting spring is simultaneously tensioned, into a switch-on setting by a measure of overtravel, and which is designed to be connected to a movable contact piece of the power switch, and having a pawl for releasably supporting the follow-up member in the switch-on setting after the first section has run off from the follow-up member, wherein the curved path exhibits, in the direction of rotation, between the trailing end of the first section and the second section, an intermediate section of a radius which becomes steadily smaller as the azimuth increases, against which intermediate section the follow-up member bears until supported against the pawl, wherein a reduction in the radius of the curved path in the intermediate section is larger than the overtravel, the reduction in the radius of the curved path in the intermediate section measures 0.2 to 5% of the difference between the largest and smallest radius of the first section.

2. A device as claimed in claim 1, wherein the intermediate section adjoins the first section.

3. A device as claimed in claim 1, wherein the intermediate section comprises an angle of 10° to 20°.

4. A device as claimed in claim 1, wherein a reduction in the radius of the curve path in the intermediate section is larger than the overtravel and the intermediate section comprises an angle of 10° to 20°.

5. A device as claimed in claim 1, wherein the intermediate section comprises an angle of 10° to 20°.

6. A device as claimed in claim 1, wherein the reduction in the radius of the curved path in the intermediate section measures 0.5 to 1.5% of the difference between the largest and smallest radius of the first section.

7. A drive device for a power switch, for medium or high voltage, having a cam disk which, for switching on the power switch, is driven by means of an energy store about an axis in a direction of rotation and which comprises a curved path which includes a first section of a radius which increases as the azimuth increases counter to the direction of rotation, and a second section which follows behind the first section in the direction of rotation and runs roughly in the radial direction, having a follow-up member which is forced by a disconnecting spring in the direction of the cam disk and which by rotation of the cam disk in the direction of rotation by means of the first section of the curved path is moved from a switch-off setting, as the disconnecting spring is simultaneously tensioned, into a switch-on setting by a measure of overtravel, and which is designed to be connected to a movable contact piece of the power switch, and having a pawl for releasably supporting the follow-up member in the switch-on setting after the first section has run off from the follow-up member, wherein the curved path exhibits, in the direction of rotation, between the trailing end of the first section and the second section, an intermediate section of a radius which becomes steadily smaller as the azimuth increases, against which intermediate section the follow-up member bears until supported against the pawl, wherein the energy store comprises a connecting spring connected to a first end of a traction element, which, eccentrically attached in an articulated manner by a second end thereof to the axis of the cam disk, is connected to the cam disk, and the trailing end of the first section of the curved path interacts with the follow-up member whenever the articulated attachment of the traction means is located at least approximately in a stable dead center position, a reduction in the radius of the curved path in the intermediate section is larger than the overtravel, the intermediate section comprises an angle of 10° to 20°, and the reduction in the radius of the curved path in the intermediate section measures 0.2 to 5% of the difference between the largest and smallest radius of the first section.

8. A device as claimed in claim 7, wherein the reduction in the radius of the curved path in the intermediate section measures 0.5 to 1.5% of the difference between the largest and smallest radius of the first section.

* * * * *